United States Patent [19]

Hess et al.

[11] 4,418,255

[45] Nov. 29, 1983

[54] CONTACT ARRANGEMENT FOR AIR-BLAST SWITCHES WITH A TUBULAR ELEMENT OF FERROMAGNETIC MATERIAL

[75] Inventors: Ruediger Hess; Heiner Marin, both of Berlin, Fed. Rep. of Germany

[73] Assignee: Siemens Aktiengesellschaft, Fed. Rep. of Germany

[21] Appl. No.: 314,009

[22] Filed: Oct. 22, 1981

[30] Foreign Application Priority Data

Oct. 30, 1980 [DE] Fed. Rep. of Germany ..... 3041083

[51] Int. Cl.[3] ..... H01H 33/18

[52] U.S. Cl. ..... 200/147 A; 200/148 R

[58] Field of Search ..... 200/147 A, 148 R

[56] References Cited

U.S. PATENT DOCUMENTS

| | | | |
|---|---|---|---|
| 4,032,737 | 6/1977 | Huhse et al. | 200/148 R |
| 4,160,140 | 7/1979 | Rolff | 200/147 A |
| 4,321,439 | 3/1982 | Hess et al. | 200/148 R |

*Primary Examiner*—Robert S. Macon

*Attorney, Agent, or Firm*—Karl F. Milde, Jr.

[57] ABSTRACT

In a contact arrangement for air-blast switches, a tubular element consisting of ferromagnetic material (the inner wall surface of which is conical and continues the contour of a nozzle aperture) is provided with a layer of graphite. The layer is formed by one or more bushings which are force fitted into the tubular element. The desired conical inner contour can be produced by machining initially cylindrical inner surfaces after mounting the bushings within the tubular element.

5 Claims, 2 Drawing Figures

CONTACT ARRANGEMENT FOR AIR-BLAST SWITCHES WITH A TUBULAR ELEMENT OF FERROMAGNETIC MATERIAL

BACKGROUND OF THE INVENTION

The invention relates to a contact arrangement for air-blast switches, provided with a tubular contact piece and a contact piece axially associated therewith. Upon cut-off under load, an arc is drawn between the contact pieces and subjected to a blast of pressurized gas. The tubular contact piece comprises at its end face a nozzle body which has a nozzle aperture contour that expands conically from the end face. In its interior the contact piece comprises, in spaced relationship, a tubular element of ferromagnetic material whose inner wall surface is conical and continues the contour of the nozzle aperture.

The tubular element of ferromagnetic material improves the arcing properties and thereby increases the switching efficiency. It has now been found that considerable burn-off may occur on the ferromagnetic material, although the arc base points move quickly on this material.

SUMMARY OF THE INVENTION

It is the object of the invention to reduce this burn-off and thereby to further increase the switching efficiency of the air-blast switch and to lengthen its life.

According to the invention, this problem is solved in that a layer of graphite is disposed on the inside of the tubular element of ferromagnetic material. This arrangement utilizes the high stability of graphite to burn-off, while maintaining the magnetic action of the tubular element. The arrangement offers the advantage that previously observed dust-like burn-off products are eliminated.

The tubular element can be provided with the graphite layer in an advantageous manner by using a bushing which has a cylindrical outer surface and a conical inner surface. In order to line a tubular element of relatively long length, according to a further embodiment of this invention, a series of several bushings with stepwise increasing outside diameters are inserted contiguous to one another within corresponding bores of the tubular element to define a continuously expanding internal space. Experience in the production of nozzle bodies of graphite has shown that such bushings can be produced with the required properties.

It is advisable to secure the bushing or bushings in the tubular element using a force fit. This can be done, for example, by pressing an oversize bushing into the tubular element by means of a pressing device, or by bringing about a shrink fit by heating the tubular element and/or by cooling the graphite bushing.

In principle, it is possible to insert a bushing having the desired inner contour into the tubular element. It has proved advantageous, however, to use a bushing or bushings having a cylindrical inner space and to create the internal conical contour by machining after insertion into the tubular element. In that case, the bushing initially has a larger cross-section and proves to be less sensitive to the stresses during pressing in or shrinking.

BRIEF DESCRIPTION OF THE DRAWINGS

The invention is explained in greater detail below, with reference to the drawings, in which.

DESCRIPTION OF THE PREFERRED EMBODIMENTS

Figure 1:
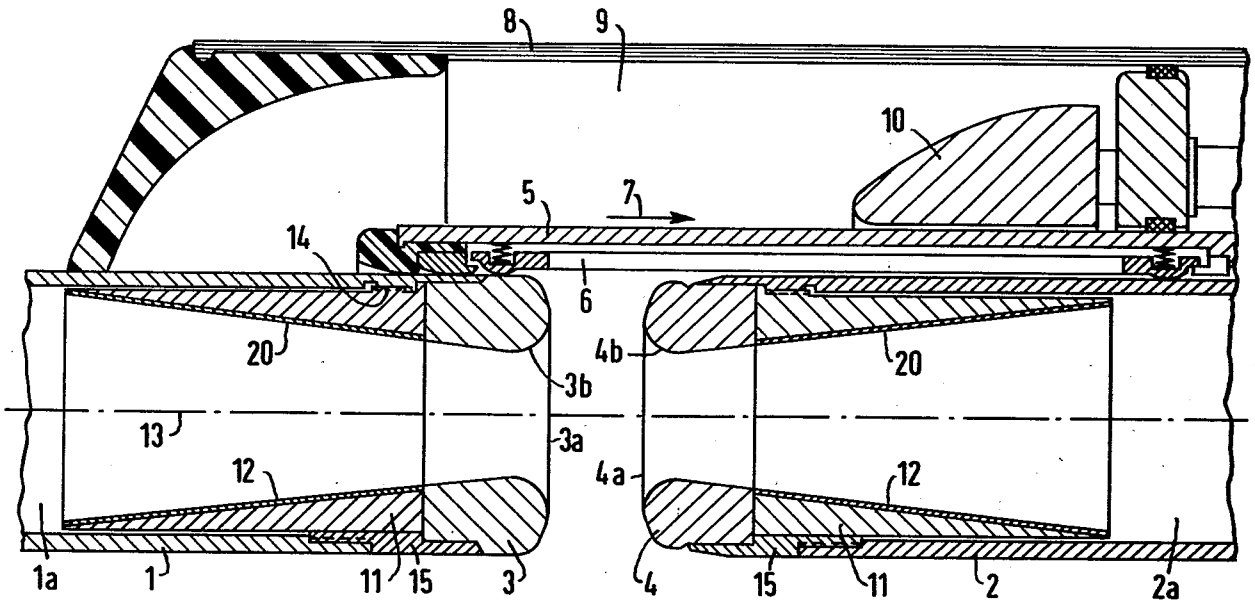
FIG. 1 is a section view of a contact arrangement of an air-blast switch constructed in accordance with the invention, showing the details of alternative embodiments of the invention above and below the center line 13.

FIG. 1 shows in section view a contact system for an air-blast switch designed as a piston switch. The contact system consists of two fixed contact pieces 1 and 2 arranged on a common axis which have end faces turned toward each other that carry nozzle bodies 3, 4 of graphite. In the contact making position shown in FIG. 1, the two contact pieces 1 and 2 are bridged by a tubular piece 5 which embraces several spring-loaded contact fingers 6 distributed over the circumference of the contact pieces 1 and 2. In the course of the contact breaking movement, a blast cylinder 8 is moved simultaneously with the tubular bridging piece 5 in the direction indicated by the arrow 7 in FIG. 1. This movement compresses the pressurized gas contained in the space 9, defined by the cylinder 8 and the substantially fixed piston 10.

As the bridging piece 5 moves off the fixed contact piece 1, an arc is drawn, which is commuted from the bridging piece 5 to the nozzle body 4. The arc now burning between the nozzle bodies 3 and 4 is driven into the interior spaces 1*a*, 2*a* of the contact pieces 1 and 2. In these interior spaces, adjacent to the nozzle bodies 3 and 4, tubular elements 11 of ferromagnetic material, in particular steel, are disposed spaced from the inner walls of the contact pieces 1 and 2.

The inner wall surfaces 12 of the tubular elements 11 are each conical in form and are adapted to the contours of the nozzle bodies 3 and 4 in such a way that the contours of the nozzle openings 3*b* and 4*b* conically expanding from the end faces 3*a*, 4*a* of the nozzle bodies 3 and 4 are continued by the contours of the tubular elements 11.

In the design shown schematically above the center line 13, the tubular element 11 is fixed in its position by a screw connection 14 with the contact piece 1, the tubular elements 11 and the nozzle bodies 3, 4 being respectively electroconductively connected together by the contact pieces 1, 2.

In another design form, shown schematically below the center line 13, the nozzle bodies 3, 4 and the tubular elements 11 are placed on electrically conducting annular intermediate bodies 15 which are respectively screwed to the contact pieces 1, 2. In both designs, the contact arrangement is provided with two similarly formed tubular elements 11.

As FIG. 1 further shows, a layer 20 of graphite is provided on the inside of the conical tubular elements 11. The construction of this graphite layer will be explained in more detail below with reference to FIG. 2.

Figure 2:
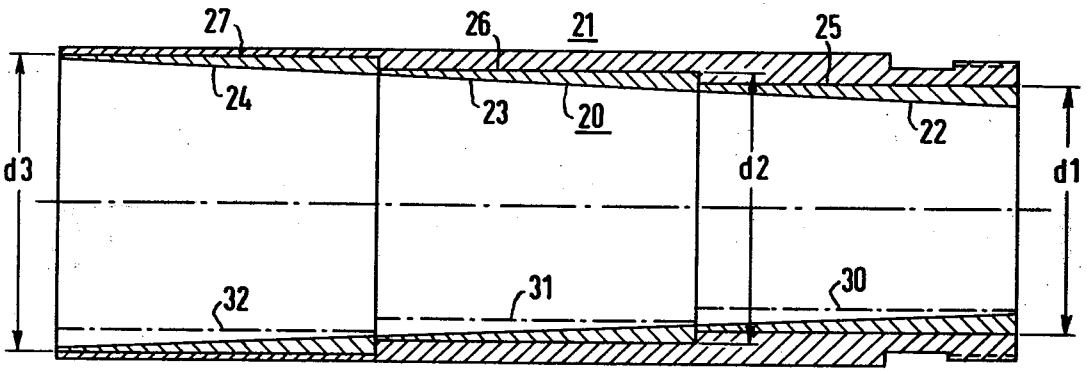
FIG. 2 is an enlarged section view of a tubular element of ferromagnetic material used in the contact arrangement shown above the center line in FIG. 1, in the interior of which are disposed three bushings of graphite, allowing alternative embodiments above and below the center line.

FIG. 2 shows in an enlarged view the details of a tubular element in accordance with the design of the element 11 shown in the upper portion (i.e. above the center line 13) of FIG. 1. As shown, the graphite layer 20 is formed by a total of three bushings 22, 23 and 24 which together form a continuous conical inner surface. The bushing 22 has a smaller outside diameter d1 than the bushing 23, and the bushing 23 in turn has a smaller outside diameter d2 than the bushing 24 (d3). Accordingly, the tubular element 21 is provided with stepped cylindrical bores 25, 26 and 27. The conical inner surface with a continuously increasing diameter may be formed by providing the bushings 22, 23 and 24 (upper portion of FIG. 2) at the time of production as single parts with appropriate matching inner contours. Alternatively, however, (as indicated at the lower portion of FIG. 2) bushings 30, 31 and 32 may be used which have a uniform wall thickness, i.e., present cylindrical openings also in the interior. Thus, there initially results a stepped interior within the tubular element 21 according to the bores 25, 26 and 27 which receive the bushings. After attachment of the bushings 30, 31 and 32 within the bores 25, 26 and 27, the conical inner configuration is then produced by chip-removing machining, e.g. on a lathe, thereby assuring a gradual or stepless transition between the bushings 30 and 31 and the bushings 31 and 32.

The attachement of the bushings can be effected by pressing them into the tubular element with the aid of a hydraulic press. The same result, namely a forced fit, can be obtained by the shrinking in of the bushings in known manner. The fitting together of the parts is here facilitated by heating or respectively cooling. After temperature equalization, the parts then sit firmly one on the other.

In the described embodiment, three bushings are provided for the production of the graphite layer 20. Alternatively, however, a smaller or a larger number of bushings may be provided. Also, other possibilities besides force or shrink fitting for fitting the bushings together, e.g. cementing or gluing, may be considered. However, since the nozzle bodies 3 and 4 are connected with the contact pieces 1 and 2 by force fitting, experience for such pressed-in connections already exist. As is further seen, the invention be used indepedently of how the tubular elements are connected with the tubular contact pieces 1 and 2. Therefore, the described lining of the elements 11, 21 with bushings of graphite is applicable in similar manner also for the embodiment form shown in the lower portion of FIG. 1.

What is claimed is:

1. A contact arrangement for an air-blast switch comprising:

a tubular first contact piece;

a second contact piece axially associated with the first contact piece and positioned so that upon cutoff under load an arc is drawn between the contact pieces and subjected to a blast of compressed gas;

the first contact piece including at its end face a nozzle body having a conical nozzle aperture contour that expands inwardly from the end face; at its interior a tubular element of ferromagnetic material having an inner wall surface; a layer of graphite disposed on said inner wall surface; and the tubular element being positioned adjacent the nozzle body so that the inner wall surface continues the contour of the nozzle of the aperture.

2. An arrangement as defined in claim 1, wherein the layer of graphite comprises a bushing having a cylindrical outer surface and a conical inner surface.

3. An arrangement as defined in claim 2, wherein the layer of graphite comprises a plurality of bushings having cylindrical outer surfaces and conical inner surfaces and being positioned end-to-end adjacently to one another within the tubular element; the diameters of the outer surfaces of the bushings increasing stepwise to fit within corresponding stepwise increasing diameter bores in the tubular element; and the contours of the inner surfaces of the adjacent bushings serving to define a continuously expanding conical interior.

4. An arrangement as defined in claim 2 or 3, wherein the bushing(s) are secured to the tubular element by means of a forced fit.

5. An arrangement as defined in claim 4, wherein the inner surface(s) of the bushing(s) are initially cylindrical but are machined to be conical after insertion into the tubular element.

* * * * *